US006226472B1

(12) United States Patent
Yun

(10) Patent No.: US 6,226,472 B1
(45) Date of Patent: May 1, 2001

(54) PRINTER AND POWER CONTROLLING METHOD THEREFOR

(75) Inventor: Jin-Su Yun, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/366,333

(22) Filed: Aug. 2, 1999

(30) Foreign Application Priority Data

Jul. 31, 1998 (KR) ..... 98-31171

(51) Int. Cl.[7] ..... G03G 15/00
(52) U.S. Cl. ..... 399/81; 399/88
(58) Field of Search ..... 399/37, 88, 81, 399/43; 345/211, 214

(56) References Cited

U.S. PATENT DOCUMENTS 5,396,443 * 3/1995 Mese et al. ..... 713/321
5,642,185 * 6/1997 Altrieth, III et al. ..... 399/81
5,652,950 * 7/1997 Kim ..... 399/70
5,880,727 * 3/1999 Barrett et al. ..... 345/357

FOREIGN PATENT DOCUMENTS 63-279655 * 11/1988 (JP) .
2-079865 * 3/1990 (JP) .
4-353887 * 12/1992 (JP) .
8-063051 * 3/1996 (JP) .
8-242322 * 9/1996 (JP) .
8-251317 * 9/1996 (JP) .

* cited by examiner

*Primary Examiner*—Robert Beatty
(74) *Attorney, Agent, or Firm*—Robert E. Bushnell, Esq.

(57) ABSTRACT

A printer and a power controlling method therefor are disclosed. The printer includes a print engine for printing a toner image on a paper; a power supply unit for supplying electric power; an engine power supply controller for controlling the power supply from the power supply unit to the print engine; a display device employing a light source for displaying information; a switch member installed for connecting or disconnecting the power supply from the power supply unit to the light source; and a controller which controls the print engine and the engine power supply controller so that an image corresponding to received print data can be printed on a paper while maintaining a print ready mode in which the print engine is supplied with enough power to perform a print job, controls the engine power supply controller so that when the print ready mode continues for a first period of time without receiving any print data from the outside, the print ready mode can be changed into a power saving mode in which power set below the power supplied to the print engine in the print ready mode is supplied to the print engine, and controls the switch member so that the switch member is in an off state so as to turn off the light source in the power saving mode. With such a printer and a method of controlling the power thereof, when the printer frequently encounters cases in which the printer in an on state is not used for a long time, the power consumption of the printer can be reduced.

23 Claims, 3 Drawing Sheets

PRINTER AND POWER CONTROLLING METHOD THEREFOR

CLAIM OF PRIORITY

This application makes reference to, incorporates the same herein, and claims all benefits accruing under 35 U.S.C. § 119 from an application entitled Printer And Power Controlling Method Therefor earlier filed in the Korean Industrial Property Office on the Jul. 31, 1998, and there duly assigned Serial No. 98-31171, a copy of which is annexed hereto.

BACKGROUND OF THE INVENTION

1. Technical Field

The present invention relates to a printer and a power controlling method for the printer, and more particularly to a printer capable of reducing power consumed while the printer is not used, and a power controlling method for the printer.

2. Related Art

A printer is an image formation device which receives data from a host computer and then forms a corresponding image onto a recordable medium such as a sheet of paper.

In a laser printer, print data are received from external equipment such as a host computer to develop the print data into printable image data. The developed image data are stored in a print image buffer. Then a laser beam, corresponding to image data of one raster read out from the print image buffer, is emitted from a laser diode to perform a main scanning operation, thereby forming an electrostatic latent image on a photosensitive drum for every dot line. Thereafter, toner is attached to the electrostatic latent image on the photosensitive drum and then transferred onto a recordable medium such as a sheet of paper. The toner on the recordable medium is heated by a fixing heater of a fixing device to fix the toner on the recordable medium, thereby completing a print process.

Laser printers are also referred to as electrophotographic printers. The host computer can be a desktop computer, a personal computer, a portable computer such as a notebook computer or palm-sized computer, or other type of computer.

I have found that power can be consumed unnecessarily by a printer when the printer is not being used.

SUMMARY OF THE INVENTION

To solve the above-referenced problem and others, it is an objective of the present invention to provide a printer capable of reducing unnecessary power consumption.

To solve the above-referenced problem and others, it is an objective of the present invention to provide a printer capable of reducing unnecessary power consumption by suppressing power consumption to the maximum extent possible while the printer is not used, and a power controlling method for the printer.

Accordingly, to achieve the above objectives and others, there is provided a printer comprising: a print engine for printing a toner image on a paper; a power supply unit for supplying electric power; an engine power supply controller for controlling the power supply from the power supply unit to the print engine; a display device employing a light source for displaying information; a switch member installed for connecting or disconnecting the power supply from the power supply unit to the light source; and a controller which controls the print engine and the engine power supply controller so that an image corresponding to received print data can be printed on a paper while maintaining a print ready mode in which the print engine is supplied with enough power to perform a print job, controls the engine power supply controller so that when the print ready mode continues for a first period of time without receiving any print data from the outside, the print ready mode can be changed into a power saving mode in which power set below the power supplied to the print engine in the print ready mode is supplied to the print engine, and controls the switch member so that the switch member is in an off state so as to turn off the light source in the power saving mode.

When print data is received during a power saving mode, the controller controls the switching member so that the light source can be turned on while the power saving mode is changed into the print ready mode for a print job to be possible.

In addition, to achieve the above objectives and others, there is provided a power controlling method for a printer which comprises a print engine for printing a toner image on a paper, a power supply unit for supplying electric power, an engine power supply controller for controlling the power supply from the power supply unit to the print engine, a controller for controlling the print engine and the engine power supply controller so that an image corresponding to received print data can be printed on a paper, and a display device provided with a light source whose power is supplied from the power supply unit for displaying information provided by the controller, comprising the steps carried out by the controller of: (a) initializing the printer by preheating the print engine to a state enabling a print job to be carried out and turning on the light source; (b) after the initializing step (a) or after completion of all previously received print jobs, maintaining a print ready mode in which the controller keeps the print engine ready for a print job by supplying the print engine with enough power to carry out a print job; (c) deciding whether there is a request to change the print ready mode into a power saving mode in which power set below the power supplied to the print engine in the print ready mode is supplied to the print engine; and (d) when there is a mode change request into the power saving mode in step (c), supplying power set below the power supplied to the print engine in the print ready mode to the print engine and turning off the light source.

To achieve these and other objects in accordance with the principles of the present invention, as embodied and broadly described, the present invention provides an apparatus, comprising: a print engine forming first visual images on a recordable medium; a power supply unit supplying a first power to said print engine; a power supply controller being coupled to said power supply unit and said print engine, said power supply controller controlling the power supplied from said power supply unit to said print engine; a display unit conveying visual information to a user, said display unit being selectively turned on and off; and a control unit receiving first print data and transmitting corresponding data to said print engine, said first visual images formed by said print engine corresponding to said first print data received by said control unit, said control unit controlling said print engine and said power supply controller to cause said first visual images to be formed on the recordable medium when said control unit selects a print ready mode, said print engine being supplied with a first quantity of power sufficient to form said first visual images on the recordable medium when said control unit selects said print ready mode, said control unit selecting a power save mode when a first predetermined quantity of time elapses without print data being received by said control unit, said control unit turning off said display unit when said control unit selects said power save mode, said control unit turning on said display unit when said control unit selects said print ready mode.

To achieve these and other objects in accordance with the principles of the present invention, as embodied and broadly described, the present invention provides an apparatus, comprising: a print engine forming first visual images on a recordable medium; a power supply unit supplying a first power to said print engine; a power supply controller being coupled to said power supply unit and said print engine, said power supply controller controlling the power supplied from said power supply unit to said print engine; a display unit conveying visual information to a user; a switch being coupled to said display unit, said switch selectively switching ON to turn on said display unit and OFF to turn off said display unit; and a control unit receiving first print data and transmitting corresponding data to said print engine, said first visual images formed by said print engine corresponding to said first print data received by said control unit, said control unit controlling said print engine and said power supply controller to cause said first visual images corresponding to said first print data to be formed on the recordable medium when said control unit selects a print ready mode, said print engine being supplied with a first quantity of power sufficient to form said first visual images on the recordable medium when said print ready mode is selected by said control unit, said control unit selecting a power save mode and not selecting said print ready mode when a first predetermined quantity of time elapses without new print data being received by said control unit, said print engine being supplied with a second quantity of power lower than said first quantity of power when said power save mode is selected by said control unit, said control unit controlling said switch to turn off said display unit when said control unit selects said power save mode, said control unit controlling said switch to turn on said display unit when said control unit selects said print ready mode.

To achieve these and other objects in accordance with the principles of the present invention, as embodied and broadly described, the present invention provides a method, comprising: initializing a printer apparatus into a print ready mode by preheating a print engine of said printer apparatus to a state enabling said print engine to form first visual images on a recordable medium and by powering on a display unit of said printer apparatus, said display unit displaying visual information provided by a control unit, said first visual images corresponding to first print data received by said control unit; when said initializing is complete, maintaining said print ready mode of said printer apparatus by supplying said print engine with a first quantity of power sufficient to form said first visual images on the recordable medium; detecting when a request is received to change said print ready mode of said printer apparatus into a power saving mode, said print engine being supplied with a second quantity of power when said print ready mode is changed into said power saving mode, said second quantity of power corresponding to a lower level of power than said first quantity of power; and when said request is received to change said print ready mode into said power saving mode, changing said print ready mode of said printer apparatus into said power saving mode and supplying said second quantity of power to said print engine and powering off said display unit.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENT

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being abroad, teaching disclosure directed to persons of skill in the appropriate arts, and not as limiting upon the present invention.

In general, a printer has a controller for controlling the processing of received print data and for controlling the overall printer system, an input device for outputting a signal according to the operation of a function key to the controller, a print engine substantially charging a print job for printing on a paper while controlled by the controller, a power supply unit for supplying electric power, and a display device.

The print engine is provided with devices which must be maintained in a heated state at a constant temperature so as to enable a normal print job to be performed, such as a transfer device for transferring and fixing a toner image formed on a photosensitive medium onto a paper. Therefore, in order to keep the print engine in a ready state to do a print job, the transfer device must be continuously supplied with electric power required for heating the transfer device.

On the other hand, when a printer is not used for a long time while in an on state, such continuous supply of power causes unnecessary power consumption. Taking this into account, most printers employ a power saving mode so as to reduce power consumption when the printer is not used over a predetermined period of time. In the power saving mode, the power supply to a print engine is not completely shut off, and power set below the power required for doing a print job is supplied to the print engine. For example, when the heated temperature of the transfer device is 100 degrees Celsius (100° C.) in a print ready mode in which a print job can be done, in the power saving mode power is supplied so that the temperature of transfer device is maintained at 50 degrees Celsius (50° C.).

However, since in the power saving mode of a printer only the power supplied to the print engine is reduced and the power for the display device is supplied so that the display device is continuously in an on state regardless of the mode, unnecessary power consumption is caused.

Figure 1:
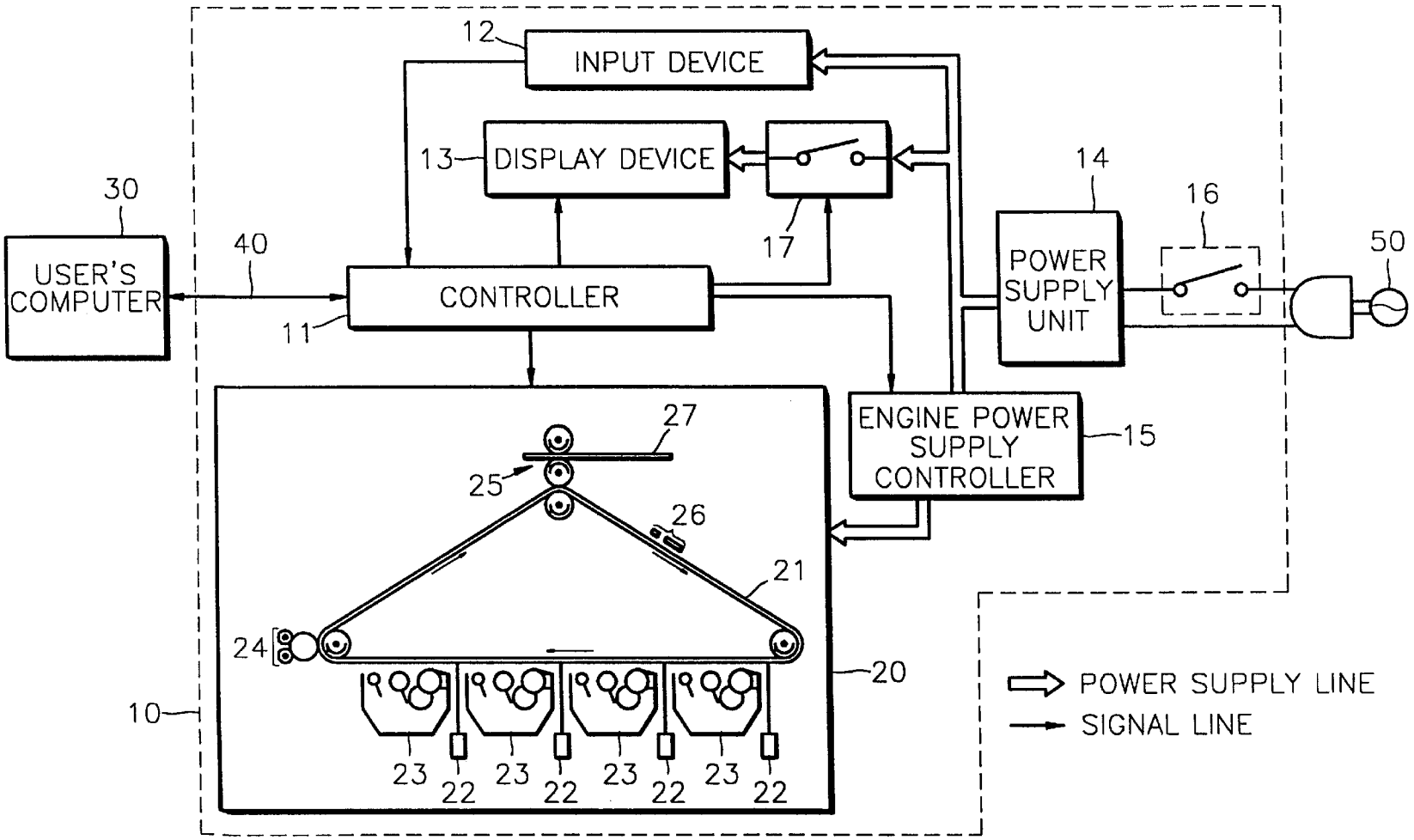
FIG. 1 is a block diagram illustrating a printer, in accordance with the principles of the present invention.

FIG. 1 shows a block diagram illustrating a printer according to the present invention. Referring to FIG. 1, a printer 10 connected to a user's computer 30 via a communication interface 40 is provided with a controller 11, an input device 12, a display device 13, a power supply unit 14, an engine power supply controller 15, a power switch 16, a switch member 17, and a print engine 20. An external power source 50 supplies power. FIG. 1 also shows a photosensitive belt 21, a plurality of optical scanning devices 22, a plurality of developing devices 23, a drying device 24, a transfer device 25, a reset device 26, and a sheet of paper 27.

Figure 2:
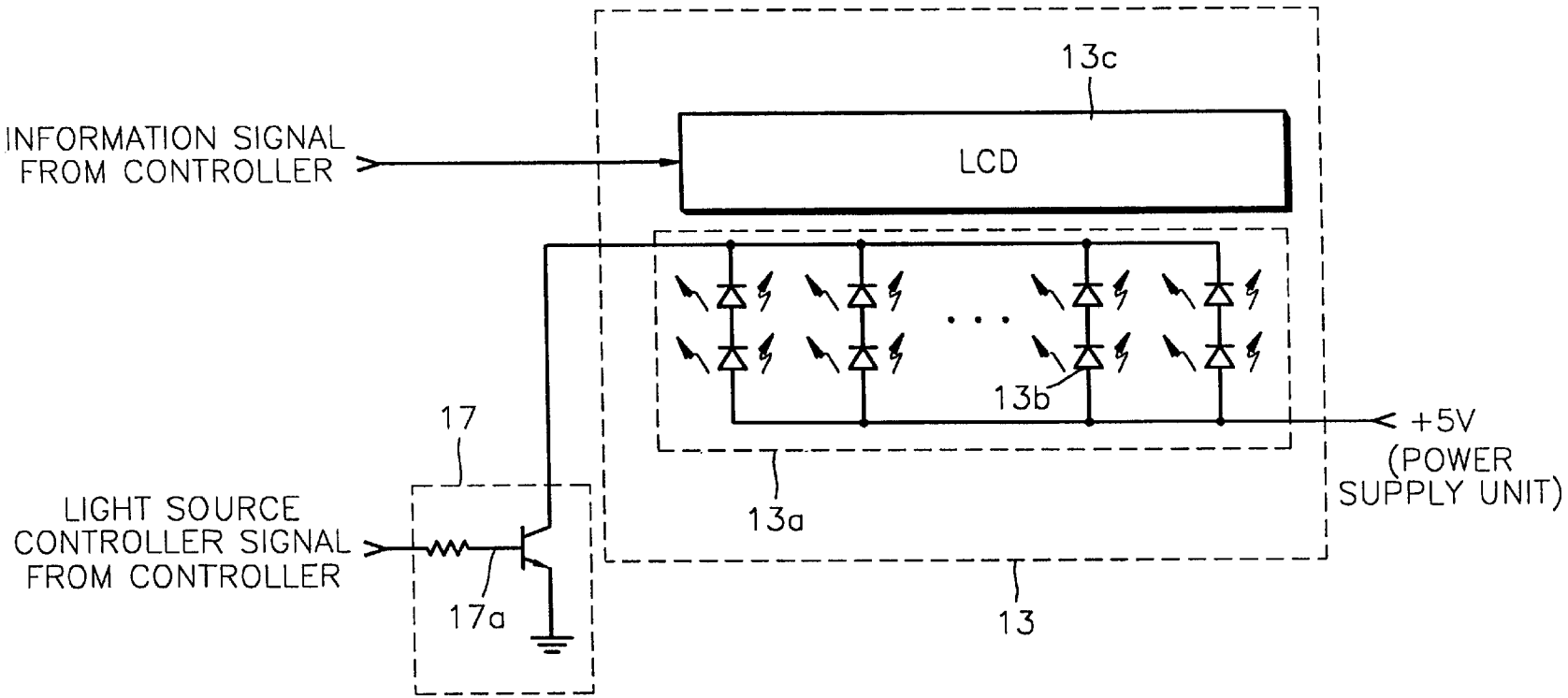
FIG. 2 is a schematic diagram illustrating a light source controlling circuit of the display device of the printer shown in FIG. 1, in accordance with the principles of the present invention.

As shown in FIG. 2, the display device 13 is provided with a light source 13*a* having an array of light emitting diodes (LEDs) 13*b* connected to each other in parallel, and a liquid crystal display (LCD) 13*c* for displaying information by selectively transmitting some of the light beams emitted from the light source 13*a,* according to an information signal output from the controller 11.

The controller 11, which controls the overall printer system, converts print data input from the computer 30 into driving data applicable to the driving of the print engine 20, and outputs the driving data to the print engine 20, and processes instructions input from the input device 12. In addition, the controller 11 controls the determination of a power mode, and controls the on/off of the switch member 17 according to the determined mode, and also controls the power supplied to the print engine 20 via the engine power supply controller 15.

The print engine 20 performs a substantial print job under the control of the controller 11. The print engine 20 for a liquid type color laser printer using inks as developers is shown in FIG. 1. The print engine 20 is provided with a plurality of optical scanning devices 22 for forming respective electrostatic latent images by scanning light beams on a circulating photosensitive belt 21, a plurality of developing devices 23 for developing the electrostatic latent images with corresponding color inks, a drying device 24 for evaporating the remaining liquid carriers on the photosensitive belt 21, a transfer device 25 for transferring the toner image formed on the photosensitive belt 21 onto a sheet of paper 27, and a reset device 26 for erasing the electrostatic latent images formed on the photosensitive belt 21 and initializing the photosensitive belt 21 so that new electrostatic latent images can be formed on the photosensitive belt 21.

The power supply unit 14 is supplied with power from an external power source 50, for example, a commercial alternating current (AC) source. The power supply unit 14 forms voltage sources for various devices of the printer including the print engine 20. The power switch 16 is intended for the user's selective operation for connecting or disconnecting power from the external power source 50 to the power supply unit 14.

The input device 12, which is installed on the outside of a main body of the printer 10, may be provided with function keys for selectively performing various print functions provided by the printer 10. The input device 12 outputs a signal corresponding to the operation of a selected key to the controller 11. The input device 12 may be provided with a power mode selection key with which a user can selectively switch from one power mode to another. The power modes include a first power mode which is a print ready mode in which power is supplied to the print engine 20 so that the print engine 20 can maintain a state capable of performing a print job, and a second power mode which is a power saving mode in which power set appropriately below the power supplied to the print engine 20 in the print ready mode is supplied to the print engine 20.

The engine power supply controller 15 controls power supplied to the print engine 20 according to the power mode selection signal. That is, when a print ready mode setting signal from the controller 11 is input into the engine power supply controller 15, the engine power supply controller 15 causes power to be supplied to heaters installed in the transfer devices 25 and the drying device 24 so that the heaters can be heated to a temperature required for a print job and maintain the heated state and the printer 10 can perform a print job immediately. On the other hand, when a power saving mode setting signal from the controller 11 is input into the engine power supply controller 15, the engine power supply controller 15 causes power to be supplied to the heaters so that the heaters can be heated to a temperature set below the temperature required for a print job and maintain the heated state. Therefore, since it takes the heaters some time to warm up to the temperature required for a print job, the user must wait until the power saving mode is changed into the print ready mode. In the power saving mode, the power supplied to the print engine 20 is decided by appropriately considering expected electric energy savings and a desirable period of heating time required for changing the power saving mode into the print ready mode.

When the printer mode is changed from the print ready mode to the power saving mode, the controller causes the switch member 17 to be turned off so that the light source 13*a* of the display device 13 can be turned off. The light source 13*a* and the display device 13 are shown in FIG. 2.

Figure 3:
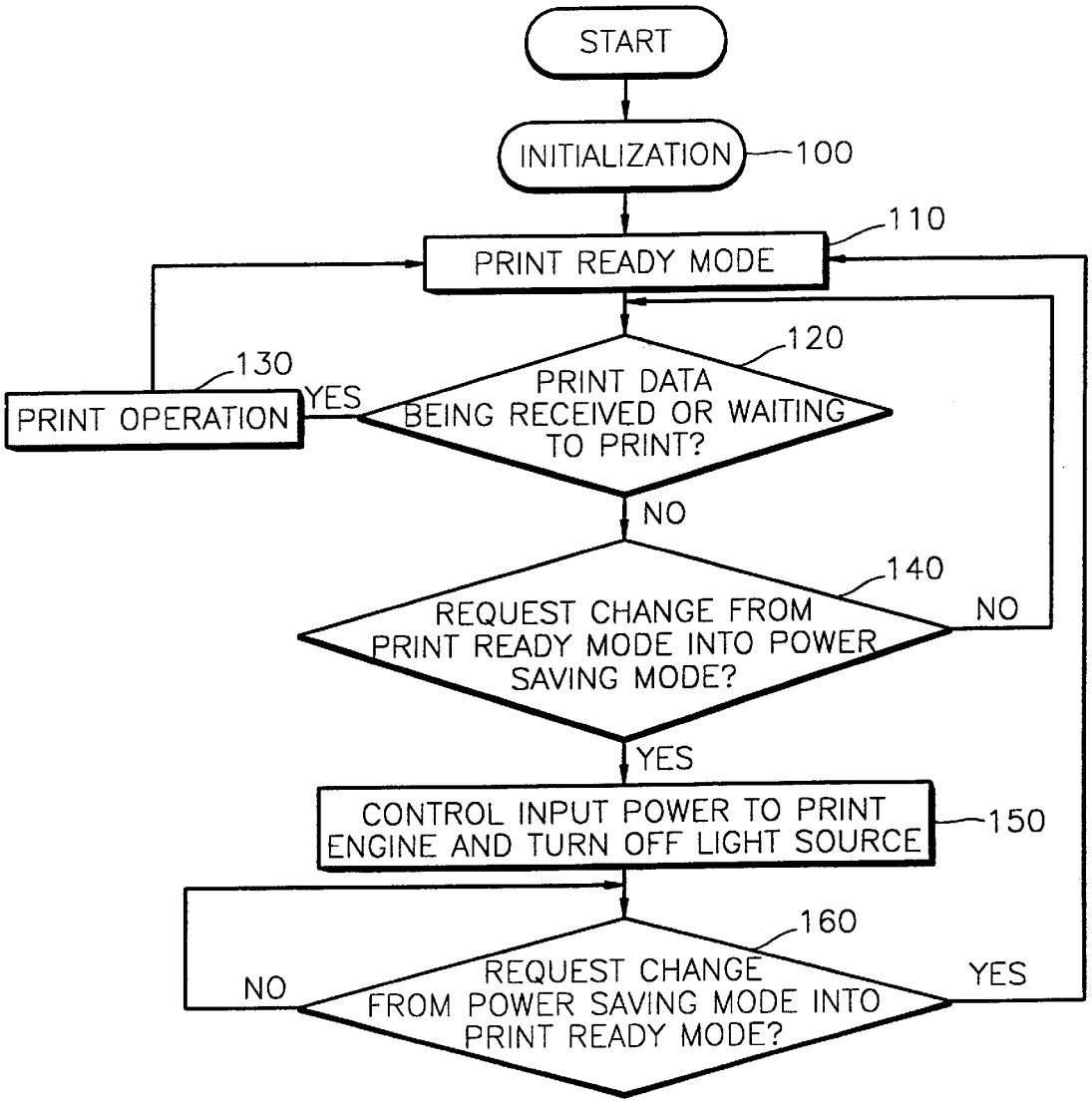
FIG. 3 is a flow chart illustrating power controlling steps for a printer, in accordance with the principles of the present invention.

Now, a process in which the controller 11 determines the power mode according to whether the controller 11 receives print data from the computer 30 via the communication interface 40 will be described with reference to FIG. 3.

At step 100, when the power switch 16 is turned on and power begins to be supplied from the external power source 50 to the power supply unit 14, the controller 11 initializes the printer by preheating the print engine 20 and maintaining a high level signal via a gate terminal 17*a* of the switch member 17 so that the light source 13*a* of the display device 13 can be turned on.

At step 110, the printer enters into the print ready mode in which a print job can be carried out. At step 120, the controller 11 starts to count clock pulses and decides whether print data is waiting to be printed or whether print data is being received.

At step 130, when there is print data in step 120, the controller 11 causes the print job to be carried out. After completion of the print job in step 130, the controller 11 restores the printer to the print ready mode at step 110.

At step 140, when there is no print data in step 120, the controller 11 decides whether there is a request to change the mode into the power saving mode. At step 140, when a first period of time which is a reference time for automatically changing the print ready mode into the power saving mode is set to 30 minutes, the controller 11 internally decides to change the mode into the power saving mode if there is no received print data within 30 minutes after the print ready mode begins.

Additionally, at step 140, during the period at which time the controller 11 is deciding whether there is a request to change the mode into the power saving mode, if a user requests a change of mode into the power saving mode by using the power mode selection key provided on the input device 12, the controller 11 then responds by internally deciding to change the mode into the power saving mode.

At step 150, when a decision is made to change the power mode into the power saving mode, the controller 11 controls the engine power supply controller 15 so that the engine power supply controller 15 reduces input power to the print engine 20, and applies a low level signal to the gate terminal 17*a* of the switch member 17 to turn off the light source 13*a* of the display device 13.

At step 160, the controller 11 decides whether there is received print data or a user's mode change request by the input device 12.

First, when print data is received, if the printer 10 is in the power saving mode when the print data is received, the controller 11 changes the mode into the print ready mode at step 110. Then the controller 11 causes the print job corresponding to the received print data waiting for printing to be carried out.

Second, when a user's mode change request is received, if the printer 10 is in the power saving mode when a user selects a particular key on the input device 12, the controller changes the mode into the print ready mode at step 110. The particular key could be a power mode selection key on the input device 12, a function selection key on input device 12, a "print test page" key, a "full power" key, or other type of key.

Also, the display device 13 is provided with a light source 13*a* having an array of light emitting diodes 13*b* connected to each other in parallel, and a display element 13*c*, wherein the display element 13*c* can be utilized to display information to a user which corresponds to the light beams emitted from the light source 13*a*, according to an information signal output from the controller 11. The display element 13*c* shown in FIG. 2 can be a liquid crystal display (LCD), a cathode ray tube, a gas-plasma display, a light emitting diode display, an electro-luminescent display, a field emission display, or other type of display unit conveying varying visual information to a user in accordance with the light emitted from the light source 13*a*, wherein the light emitted from the light source 13*a* is in accordance with the information signal output from the controller 11.

The display element 13*c* can display information such as a current operating mode, for example PRINT READY MODE. The display element 13*c* can display information such as PROCESSING DATA when the control unit 11 is receiving data from the host computer 30. The display element 13*c* can display a TONER LOW message and a PAPER TRAY LOW message and a POWER ON message and other types of messages to a user.

As described above, with a printer and a power controlling method for the printer according to the present invention, while the printer is in a power saving mode because the printer is not used for a predetermined time, power consumption can be further reduced by additionally turning off a light source of a display device which can be turned on without having substantial influence on restoring the printer to a print ready mode.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An apparatus, comprising:

a print engine forming first visual images on a recordable medium;

a power supply unit supplying a first power to said print engine;

a power supply controller being coupled to said power supply unit and said print engine, said power supply controller controlling the power supplied from said power supply unit to said print engine;

a display unit conveying visual information to a user, said display unit being selectively turned on and off; and a control unit receiving first print data and transmitting corresponding data to said print engine, said first visual images formed by said print engine corresponding to said first print data received by said control unit, said control unit controlling said print engine and said power supply controller to cause said first visual images to be formed on the recordable medium when said control unit selects a print ready mode, said print engine being supplied with a first quantity of power sufficient to form said first visual images on the recordable medium when said control unit selects said print ready mode, said control unit selecting a power save mode when a first predetermined quantity of time elapses without print data being received by said control unit, said control unit powering off said display unit when said control unit selects said power save mode, said control unit powering on said powered off display unit when said control unit selects said print ready mode, said control unit selecting said print ready mode in response to one event selected from among print data being received and a user's mode change request being received.

2. The apparatus of claim 1, further comprising said print engine being supplied with a second quantity of power lower than said first quantity of power when said power save mode is selected by said control unit.

3. The apparatus of claim 1, further comprising said control unit selecting said print ready mode and not selecting said power save mode when the new print data is received.

4. The apparatus of claim 1, said display unit further comprising a light source emitting light beams, in accordance with the control unit.

5. The apparatus of claim 4, said display unit further comprising a liquid crystal display selectively transmitting light beams emitted from said light source, in accordance with said control unit.

6. An apparatus, comprising:

a print engine forming first visual images on a recordable medium;

a power supply unit supplying a first power to said print engine;

a power supply controller being coupled to said power supply unit and said print engine, said power supply controller controlling the power supplied from said power supply unit to said print engine;

a display unit conveying visual information to a user;

a switch being coupled to said display unit, said switch selectively switching ON to turn on said display unit and OFF to turn off said display unit; and a control unit receiving first print data and transmitting corresponding data to said print engine, said first visual images formed by said print engine corresponding to said first print data received by said control unit, said control unit controlling said print engine and said power supply controller to cause said first visual images corresponding to said first print data to be formed on the recordable medium when said control unit selects a print ready mode, said print engine being supplied with a first quantity of power sufficient to form said first visual images on the recordable medium when said print ready mode is selected by said control unit, said control unit selecting a power save mode and not selecting said print ready mode when a first predetermined quantity of time elapses without new print data being received by said control unit, said print engine being supplied with a second quantity of power lower than said first quantity of power when said power save mode is selected by said control unit, said control unit controlling said switch to power off said display unit when said control unit selects said power save mode, said control unit controlling said switch to power on said powered off display unit when said control unit selects said print ready mode, said control unit selecting said print ready mode in response to one event selected from among print data being received and a user's mode change request being received.

7. The apparatus of claim 6, wherein said display unit is selected from the group consisting of a liquid crystal display, a cathode ray tube, a gas-plasma display, a light emitting diode display, an electro-luminescent display, and a field emission display.

8. The apparatus of claim 6, said display unit further comprising a light source emitting light beams in accordance with the control unit.

9. The apparatus of claim 8, further comprising said switch selectively switching ON to turn on said light source of said display unit and OFF to turn off said light source of said display unit, in accordance with said control unit.

10. The apparatus of claim 6, further comprising a host computer outputting said first print data to said control unit.

11. The apparatus of claim 7, further comprising a host computer outputting said first print data to said control unit.

12. The apparatus of claim 8, further comprising a host computer outputting said first print data to said control unit.

13. The apparatus of claim 9, further comprising a host computer outputting said first print data to said control unit.

14. The apparatus of claim 6, further comprising said control unit receiving said first print data from a host computer, said control unit transmitting first driving data to said print engine corresponding to said first print data, said first driving data being for driving said print engine.

15. A method, comprising:

initializing a printer apparatus into a print ready mode by preheating a print engine of said printer apparatus to a state enabling said print engine to form first visual images on a recordable medium and by powering on a display unit of said printer apparatus, said display unit displaying visual information provided by a control unit, said first visual images corresponding to first print data received by said control unit;

when said initializing is complete, maintaining said print ready mode of said printer apparatus by supplying said print engine with a first quantity of power sufficient to form said first visual images on the recordable medium;

detecting when a power save request is received to change said print ready mode of said printer apparatus into a power saving mode, said print engine being supplied with a second quantity of power when said print ready mode is changed into said power saving mode, said second quantity of power corresponding to a lower level of power than said first quantity of power;

when said power save request is received to change said print ready mode into said power saving mode, changing said print ready mode of said printer apparatus into said power saving mode and supplying said second quantity of power to said print engine and powering off said display unit;

detecting when a power-on request is received to change said power saving mode into said print ready mode, said power-on request corresponding to one event selected from among print data being received and a user's mode change request being received; and when said power-on request is received, changing said power saving mode into said print ready mode and powering on said powered off display unit.

16. The method of claim 15, further comprising said first print data being transmitted to said control unit located within said printer apparatus from a computer external to said printer apparatus.

17. The method of claim 16, further comprising:

turning on a light source in said display unit when said initializing of said printer apparatus is performed and when said power saving mode is changed to said print ready mode; and turning off said light source when said print ready mode is changed to said power saving mode.

18. The method of claim 16, further comprising said control unit controlling said initializing of said printer apparatus, said preheating of said print engine by controlling power supplied to said print engine from a power supply, said powering on of said display unit by controlling power supplied to said display unit from a power source, said maintaining of said print ready mode, said detecting, said supplying of said first quantity of power by controlling power supplied to said print engine from said power supply, said changing of said print ready mode into said power saving mode, said supplying of said second quantity of power by controlling power supplied to said print engine from said power supply, and said powering off of said display unit by controlling power supplied to said display unit from the power source.

19. The method of claim 18, further comprising said control unit detecting said power save request to change said print ready mode into said power saving mode when said print ready mode continues for a first predetermined quantity of time without new print data being received by said control unit.

20. The method of claim 19, said user's mode change request corresponding to one selected from among the user pressing a print-test-page key and the user pressing a full-power key.

21. An apparatus, comprising:

a control unit outputting first and second control signals;

a display unit conveying visual information to a user, said display unit being selectively powered on and powered off;

a switch being coupled to said display unit and said control unit, said switch closing to convey power to said display unit to power on said display unit, said switch opening to not convey power to said display unit to power off said display unit;

a print engine receiving a first power to form images on a recordable medium when in a print ready mode, said print engine receiving a second power less than the first power when in a power save mode, said second power maintaining said print engine in a warm condition; and a power supply controller conveying power to said display unit through said switch and selectively conveying the first and second powers to said print engine;

when said power save mode is requested, said control unit outputting said second control signal to said switch to open said switch and power off said display unit and outputting said first control signal to said power supply controller to reduce power being supplied to said print engine from the first power to the second power.

22. The apparatus of claim 21, further comprising an input unit being coupled to said control unit and receiving power, said request for said print save mode being conveyed from a user to said control unit through said input unit.

23. The apparatus of claim 21, further comprising:

a host computer being coupled to said control unit; and an input unit being coupled to said control unit;

said request for said print save mode corresponding to one event selected from among a user inputting said request through said input unit and a print request being initiated by said host computer.

* * * * *